US011149758B2

(12) United States Patent
Callesen et al.

(10) Patent No.: US 11,149,758 B2
(45) Date of Patent: Oct. 19, 2021

(54) CONTROL ARRANGEMENT OF A HYDRAULIC SYSTEM AND A METHOD FOR CONTROLLING A HYDRAULIC SYSTEM

(71) Applicant: Danfoss Power Solutions ApS, Nordborg (DK)

(72) Inventors: Frede Callesen, Odense S (DK); Dirk Wroblewski, Flensburg (DE)

(73) Assignee: DANFOSS POWER SOLUTIONS APS, Nordborg (DK)

( * ) Notice: Subject to any disclaimer, the term of this patent is extended or adjusted under 35 U.S.C. 154(b) by 1050 days.

(21) Appl. No.: 14/785,956

(22) PCT Filed: Mar. 31, 2014

(86) PCT No.: PCT/EP2014/056475

§ 371 (c)(1),
(2) Date: Oct. 21, 2015

(87) PCT Pub. No.: WO2014/195041

PCT Pub. Date: Dec. 11, 2014

(65) Prior Publication Data

US 2016/0069360 A1 Mar. 10, 2016

(30) Foreign Application Priority Data

Jun. 4, 2013 (EP) ..... 13170453

(51) Int. Cl.
*F15B 11/042* (2006.01)
*F15B 13/04* (2006.01)
(Continued)

(52) U.S. Cl.
CPC ..... *F15B 13/04* (2013.01); *F15B 11/08* (2013.01); *F15B 21/087* (2013.01); *F15B 2211/3057* (2013.01); *F15B 2211/30565* (2013.01)

(58) Field of Classification Search
CPC .... F15B 2211/30565; F15B 2211/3057; F15B 11/042
See application file for complete search history.

(56) References Cited

U.S. PATENT DOCUMENTS

| | | | |
|---|---|---|---|
| 5,568,759 | A | 10/1996 | Aardema |
| 7,243,591 | B2 | 7/2007 | Dixen et al. |
| 2005/0072954 | A1 | 4/2005 | Nielsen |

FOREIGN PATENT DOCUMENTS

| | | | |
|---|---|---|---|
| CN | 1175988 | A | 3/1998 |
| CN | 1601117 | A | 3/2005 |

(Continued)

OTHER PUBLICATIONS

International Search Report for PCT Serial No. PCT/EP2014/056475 dated Jun. 18, 2014.

*Primary Examiner* — F Daniel Lopez
(74) *Attorney, Agent, or Firm* — McCormick, Paulding & Huber PLLC

(57) ABSTRACT

A control arrangement (5) of a hydraulic system (1) is provided, said control arrangement (5) comprising a supply port arrangement having a high pressure port (6) and a low pressure port (7), a working port arrangement having two working ports (8, 9), a first valve (10) arranged between said high pressure port (6) and said working port arrangement (8, 9), a second valve (11) arranged between said low pressure port (7) and said working port arrangement (8, 9). Such a control arrangement should enhance the control of a hydraulic system. To this end a controller (16) is provided for controlling said first valve (10) and said second valve (11), said controller (16) has an input connection (17) for receiving a signal of an operator input device and on the basis of said signal said controller at least initially calculates an unbalance between a first flow demand for said first valve (10) and a second flow demand for said second valve (11), (Continued)

and adjusts said first valve (10) according to said first flow demand and said second valve (11) according to said second flow demand.

15 Claims, 1 Drawing Sheet

(51) Int. Cl.
*F15B 21/08* (2006.01)
*F15B 11/08* (2006.01)

(56) References Cited

FOREIGN PATENT DOCUMENTS

| | | | |
|---|---|---|---|
| CN | 1683797 | A | 10/2005 |
| CN | 1760557 | A | 4/2006 |
| CN | 101413522 | A | 4/2009 |
| CN | 101413523 | A | 4/2009 |
| DE | 10 2009 012 722 | A1 | 10/2010 |
| WO | 96/27051 | A1 | 9/1996 |

CONTROL ARRANGEMENT OF A HYDRAULIC SYSTEM AND A METHOD FOR CONTROLLING A HYDRAULIC SYSTEM

CROSS-REFERENCE TO RELATED APPLICATION

This application is entitled to the benefit of and incorporates by reference subject matter disclosed in the International Patent Application No. PCT/EP2014/056475 filed on Mar. 31, 2014 and European Patent Application Serial No. 13170453 filed Jun. 4, 2013.

TECHNICAL FIELD

The present invention relates to a control arrangement of a hydraulic system, said control arrangement comprising a supply port arrangement having a high pressure port and a low pressure port, a working port arrangement having two working ports, a first valve arranged between said high pressure port and said working port arrangement, and a second valve arranged between said low pressure port and said working port arrangement.

Furthermore, the present invention relates to a method for controlling a hydraulic system comprising a supply port arrangement having a high pressure port and a low pressure port, a working port arrangement having two working ports, a first valve arranged between said high pressure port and said working port arrangement, and a second valve arranged between said low pressure port and said working port arrangement, the method comprising generating an input signal for said hydraulic system.

BACKGROUND

Such a control arrangement and such a method are known from WO 96/27051 A1. In the system shown in this reference, the flow to the working port arrangement and to an actuator connected to said working port arrangement and the flow back from the actuator can be controlled independently. One valve provides pressurized fluid to the actuator and the other valve connects the fluid coming from the actuator with the return line of the hydraulic system or the low pressure connection.

SUMMARY

The object underlying the invention is to enhance the control of a hydraulic circuit.

This object is solved in that a controller is provided for controlling said first valve and said second valve, said controller has an input connection for receiving a signal of an operator input device and on the basis of said signal said controller at least initially calculates an unbalance between a first flow demand for said first valve and a second flow demand for said second valve, and adjusts said first valve according to the first flow demand and said second valve according to said second flow demand.

In the following, a flow of pressurized fluid from the high pressure port to the working port arrangement is called "meter-in flow" and the fluid coming from the working port arrangement to the low pressure port of the hydraulic system is called "meter-out flow".

The input signal from the operator's input device represents the meter-in flow and gets converted by the controller into a flow demand for both valves separately. The flow demand is a quantity representing the flow which should be able to pass through the valve. In other words, the flow demand is representative of the opening degree of the valve related to a pressure difference over the valve. Basically, the flow demand for the first valve should be equal to the flow demand of the second valve, depending on the type of actuator. If the actuator is a differential cylinder, the cylinder ratio is additionally taken into account for the calculation of the ratio between the meter-in flow demand and the meter-out flow demand. The controller adjusts the first valve and the second valve so that, for example, the demanded meter-out flow is slightly higher than the demanded meter-in flow. This apparent unbalance avoids intended back-pressure in the actuator but still enables the operator to control the actuator speed for both positive and negative actuator forces. As will be clear from the following, the first flow corresponds to the meter-in flow and the second flow corresponds to the meter-out flow and consequently the first flow demand corresponds to the meter-in flow demand and the second flow demand corresponds to the meter-out flow demand.

It is preferred that the controller calculates a first flow demand for said first valve and a second flow demand for said second valve. The flow demand for both valves is calculated separately.

In many cases it is sufficient to have a fixed difference between the first flow demand and the second flow demand. However, in some cases it is an advantage that, depending on a load condition at the working port arrangement, said controller corrects said first flow demand and/or said second flow demand. In this way, it is possible to increase or decrease the difference between the first flow demand and the second flow demand. In many cases the load direction is predictable and for those cases it is sufficient to control either the meter-in flow or the meter-out flow of a hydraulic actuator. When the load direction is not predictable, a control logic has to observe the actual load and switch the control method between meter-in flow control and meter-out flow control. However, in some cases it is an advantage that a control logic must not determine which load direction is present and thereby avoiding abrupt transitions between the two control methods, associated with abrupt actuator velocity changes.

Preferably, said controller is connected to first pressure drop measuring means measuring a first pressure drop over said first valve and/or to second pressure drop measuring means measuring a second pressure drop over said second valve. Using pressure drop measuring means, the controller is able to adjust the respective valve to the given flow demand. The measured pressure drop is a valuable information for the controller.

Preferably, said first valve and said second valve each comprise means for indicating an opening degree, said means being connected to said controller. The means for indicating an opening degree can, for example, be a position sensor sensing a position of a valve element within a valve housing. The position of the valve element is an indication for the magnitude of the metering area. Therefore, the controller and the first valve form a first closed loop control circuit. According to the measured pressure drop over the first valve and according to the metering area known from the means for indicating an opening degree, the controller can adjust the first valve in order to meet the flow demand given from the controller. The same is true for the second valve forming, together with the controller, a second closed loop control circuit.

Preferably, said first valve and/or said second valve are spool valves. In a spool valve a spool is moved within a housing. The position of the spool is an indication of the metering area. Therefore, if the position of the spool in the housing is known, the "opening degree" or the metering area are known as well.

Preferably, in case of a positive load, the first valve determines the velocity of an actuator connected to said working port arrangement and a back pressure is automatically adjusted to its minimum level. In this way, a reliable control of the speed or velocity of the actuator is guaranteed and at the same time a back-pressure is present, however, on a minimum level.

In an additional or alternative embodiment, in case of a negative load, the second valve determines the velocity of an actuator connected to said working port arrangement and the first valve determines an anti-cavitation pressure. The determination of the velocity of the actuator is switched from the first valve to the second valve, depending on the load condition. In any case, cavitation is avoided.

The object is solved in a method as mentioned above in that a first flow demand for the first valve and a second flow demand for the second valve are calculated separately to create at least initially an unbalance between said first flow demand and said second flow demand.

As mentioned above in connection with the hydraulic control arrangement, this unbalance has the effect that, for example, the second valve in case of a positive load is adjusted to a larger opening degree than it would be necessary per se. Therefore the energy consumption can be minimized.

Preferably, the first valve determines the velocity of an actuator connected to the working port arrangement and a back pressure is automatically adjusted to its minimum level. The first valve is used to control the flow from the high pressure port to the working port arrangement.

Additionally or alternatively in case of a negative load, the second valve determines the velocity of an actuator connected to said working port arrangement and the first valve determines an anti-cavitation pressure. In case of a negative load, the second valve determines the flow from the working port arrangement to the low pressure port and the first valve is used for anti-cavitation purposes.

BRIEF DESCRIPTION OF THE DRAWINGS

A preferred example of the invention will now be described in more detail with reference to the drawing, wherein.

DETAILED DESCRIPTION

Figure 1:
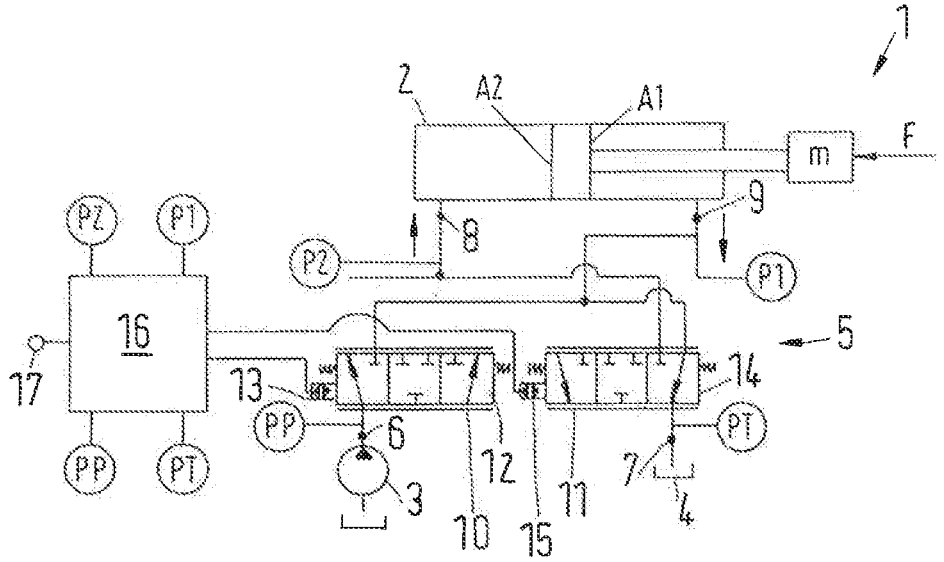
FIG. 1 is a schematic illustration of a control arrangement and an actuator under positive load and FIG. 2 is a schematic illustration of the control arrangement and the actuator under negative load.

FIG. 1 shows a hydraulic system 1. The hydraulic system comprises an actuator 2, a pressure source in form of a pump 3 and a tank 4. Furthermore, the hydraulic system comprises a control arrangement 5. The control arrangement 5 comprises a supply port arrangement having a high pressure port 6 and low pressure port 7. The high pressure port 6 is connected to the pump 3. The low pressure port 7 is connected to the tank 4. Furthermore, the control arrangement 5 comprises a working port arrangement having a first working port 8 and a second working port 9. The two working ports 8, 9 are connected to the actuator 2.

Furthermore, the control arrangement 5 comprises a first valve 10 and a second valve 11. Both valves 10, 11 are in the form of spool valves. The first valve 10 comprises a first spool 12, which can be moved by a first spool drive 13. The second valve 11 comprises a second spool 14, which can be moved by a second spool drive 15.

The first valve 10 controls a flow of fluid from the high pressure port 6 to one of the working ports 8, 9, depending on the position of the spool 12. In other words, the first valve 10 controls the meter-in flow, because it controls the flow of fluid flowing into the actuator 2.

The second valve 11 controls the flow of fluid from the working port arrangement to the low pressure port 7. In other words, the second valve 11 controls the flow of fluid coming out of the actuator 12, i.e. the meter-out flow.

Both valves 10, 11 are controlled by a controller 16. The controller 16 is connected to the first spool drive 13 and to the second spool drive 15. In a preferred embodiment the spool drives 13, 15 may be realized in form of a bridge with several solenoids, e.g. four solenoids, working in a bridge and performing, by means of a pilot oil supply, opening and closing of a connection to tank or pilot oil supply, thus displacing the valve slide or element. However, also other methods of displacing the valve element can be imagined.

The control arrangement 5 furthermore comprises pressure drop measuring means. In order to simplify the illustration, pressure sensors PP, PT, P1, P2 are shown. The pressure sensor PP is connected to the high pressure port 6. The sensor PT is connected to the low pressure port 7. The sensor P1 is connected to working port 9 and the pressure sensor P2 is connected to working port 8. All pressure sensors PP, PT, P1 and P2 are connected to the controller 16. Therefore, the controller 16 is able to detect a pressure drop over the first valve 10 (depending on the position of the spool 12, this pressure drop is the difference between P2 and PP or between P1 and PP). The controller 16 is able to determine the pressure drop over the second valve 11 as well (depending on the position of the second spool 14, this is the difference between P1 and PT or between P2 and PT).

The spool drives 13, 15 feed back to the controller 16 an information about the position of the respective spool 12, 14. Therefore, the controller 16 "knows" the opening degree, in other words, the metering area of the first valve 10 and the second valve 11. The spool 12, 14 can be, for example, be provided with a position measuring device, in a preferred embodiment a sensor working by means of an LVDT transducer, however, also other means of measuring principles can be used as well.

The controller 16 furthermore comprises an input connection 17 for receiving a signal of an operator input device, e.g. a joystick.

The input signal from the operator's input device represents the meter-in flow and get converted by the converter 16 into a flow demand for both valves 10, 11, separately. The flow demand is a quantity indicating the flow of fluid which could pass through each valve 10, 11 of, if the pressure drop over the valve is known, an indication of the opening degree or metering area. If the actuator 2 as shown, is a differential cylinder, the cylinder ratio (ratio between the pressure areas A2 and A1) is taken into account for the calculation of the meter-out flow demand.

According to the measured pressure drop across the metering edges of the valve 10, 11 and according to the known metering area of the valves 10, 11, the position of the spools 12, 14 gets always adjusted in order to meet the given flow demand from the controller. The demanded meter-out flow is at least initially slightly higher than the demanded meter-in flow. This apparent unbalance avoids unintended back-pressure in the actuator 2 but still enables the operator to control the speed of the actuator 2 for both positive and negative actuator forces.

Positive load is given when the actuator force F counteracts the motion of the actuator. Such a situation is shown in FIG. 1. The feed pressure P2 reflects the actuator force F and back-pressure P1. The back-pressure P1 is determined by the sum of throttling losses in the line between the actuator 2 and the second valve 11, across the metering edges of the second valve 11 itself and in the line between the second valve 11 and the low pressure port 7.

The flow control at the second valve 11 demands slightly higher meter-out flow than the first valve 10 would meter into the actuator 2. The meter-in/meter-out flow balance of the actuator 2 is disturbed and lowers the back-pressure P1. The lowered back-pressure P1 requires a wider opening of the second valve 11 in order to maintain the demanded flow through the second valve 11. The continued flow unbalance lets sink the back-pressure P1 even more, which again forces the second valve 11 to open more. This sequence continues until the second valve 11 reaches its maximum spool position or opening degree. Then the second valve 11 does no longer control any longer the meter-out flow. For keeping the demanded meter-out flow a much higher opening of the second valve 11 would be required, which cannot be provided due to the spool position saturation. The actual flow through the second valve 11 lowers until it meets the meter-in/meter-out flow equilibrium of the actuator 2.

The flow through the first valve 10 (meter-in flow) determines the velocity of the actuator. The back-pressure is automatically adjusted to its minimum level.

Figure 2:
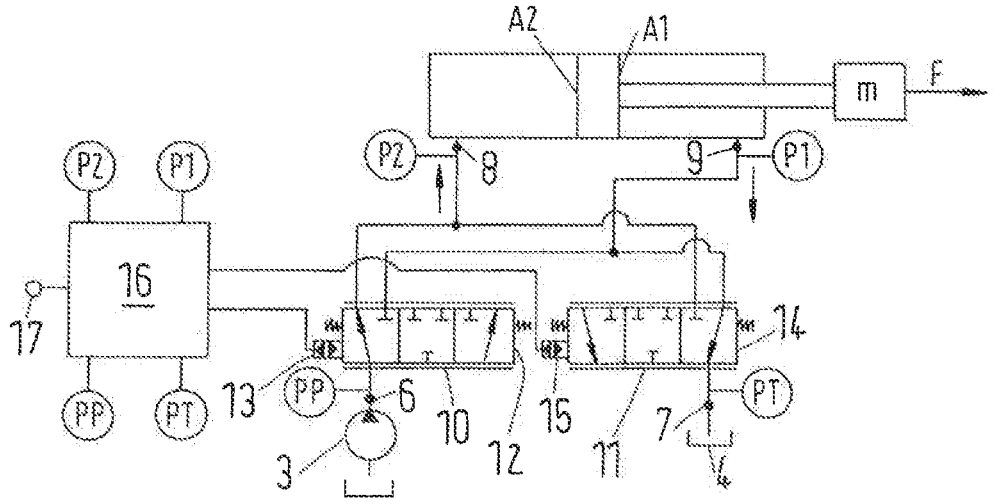

Negative load is given when the actuator force F has the same direction as the motion of the actuator 2. This situation is shown in FIG. 2. The feed-pressure P2 is typically close to zero. The back-pressure P1 reflects the actuator force F and the sum of throttling losses in the line between the actuator 2 and the second valve 11, across the metering edges of the second valve 11 itself and in the line between the second valve 11 and the low pressure port 7.

The flow control at the second valve 11 demands slightly higher meter-out flow than the first valve 10 would meter into the actuator 2. As there is sufficient pressure drop across the second valve 11, the second valve 11 will settle to a particular spool position where the meter-out flow matches the flow demand. Due to negative actuator force the back-pressure P1 will not sink and the unbalanced flow equilibrium at the actuator 2 is the reason for the lowering of the feed-pressure P2. The feed-pressure P2 would settle to values below zero as the actuator 2 displaces more fluid volume than provided by the meter-in flow through the first valve 10 due to the higher meter-out flow. The avoidance of the cavitation effect is subject of an additional function.

This anti-cavitation function ensures a minimum feed-pressure level. It monitors the feed-pressure P2 and demands more meter-in flow when the feed-pressure P2 drops below a defined level (anti-cavitation pressure). By providing more meter-in flow than initially demanded by the flow control, the flow equilibrium at the actuator 2 is balanced and the feed-pressure P2 stops lowering. When the anti-cavitation pressure is reached, the additional meter-in flow demand is going to be reduced gradually until the initial flow demand by the flow control remains. So, the anti-cavitation function is always present in the background and when the feed-pressure drops below cavitation critical levels, it provides more meter-in flow to the actuator 2. The second valve 11 (meter-out flow) determines the velocity of the actuator 2. The feed-pressure P2 settles on its minimum level (anti-cavitation pressure).

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for controlling a hydraulic system comprising a supply port arrangement having a high pressure port and a low pressure port, a working port arrangement connected to an actuator having two working ports, a first valve arranged between said high pressure port and said working port arrangement, and a second valve arranged between said low pressure port and said working port arrangement, the method comprising generating an input signal for said hydraulic system, wherein a first flow demand for the first valve and a second flow demand for the second valve are calculated separately to create at least initially an unbalance between said first flow demand and said second flow demand, each flow demand being a quantity representing a flow to pass through the first valve or the second valve respectively, wherein the unbalance between the first flow demand and the second flow demand indicates that the first flow demand and the second flow demand do not correspond to a cylinder ratio of the actuator.

2. The method according to claim 1, wherein in case of a positive load, the first valve determines the velocity of an actuator connected to said working port arrangement and a back pressure is automatically adjusted to its minimum level.

3. The method according to claim 1, wherein, in case of a negative load, the second valve determines the velocity of an actuator connected to said working port arrangement and the first valve determines an anti-cavitation pressure.

4. A control arrangement of a hydraulic system comprising:

a supply port arrangement having a high pressure port and a low pressure port;

a working port arrangement connected to an actuator having a first working port and a second working port;

a first valve arranged between said high pressure port and said working port arrangement;

a second valve arranged between said low pressure port and said working port arrangement; and a controller for controlling said first valve and said second valve;

wherein fluid flowing from said high pressure port to said first working port or said second working port is meter-in flow;

wherein fluid flowing from said first working port or said second working port to said low pressure port is meter-out flow;

wherein said controller has an input connection for receiving a signal of an operator input device and on the basis of said signal said controller controls said first valve and said second valve such that the ratio of a quantity the meter-out flow to a quantity of the meter-in flow is greater than a cylinder ratio of said actuator; and wherein said cylinder ratio of said actuator is an out pressure area to an in pressure area, said out pressure area being fluidly connected with said low pressure port and said in pressure area being fluidly connected with said high pressure port.

5. The control arrangement according to claim 4, wherein, depending on a load condition at the working port arrangement, said controller corrects said meter-in flow and/or said meter-out flow.

6. The control arrangement according to claim 5, further comprising a first pressure sensor (P2) connected to the first working port, a second pressure sensor (P1) connected to the second working port, a third pressure sensor (PP) connected to the high pressure port and a fourth pressure sensor (PT) connected to the low pressure port, wherein said controller is configured to detect a first pressure drop over said first valve due to the load condition, based on a difference between the first pressure sensor (P2) and the third pressure sensor (PP) or based on a difference between the second pressure sensor (P1) and the third pressure sensor (PP), and wherein said controller is configured to detect a second pressure drop over said second valve due to the load condition, based on a difference between the second pressure sensor (P1) and the fourth pressure sensor (PT) or based on a difference between the first pressure sensor (P2) and the fourth pressure sensor (PT).

7. The control arrangement according to claim 5, wherein said first valve and/or said second valve are spool valves.

8. The control arrangement according to claim 5, wherein, in case of a positive load, the first valve determines the velocity of the actuator connected to said working port arrangement and a back pressure is automatically adjusted to its minimum level.

9. The control arrangement according to claim 4, further comprising a first pressure sensor (P2) connected to the first working port, a second pressure sensor (P1) connected to the second working port, a third pressure sensor (PP) connected to the high pressure port and a fourth pressure sensor (PT) connected to the low pressure port, wherein said controller is configured to detect a first pressure drop over said first valve, based on a difference between the first pressure sensor (P2) and the third pressure sensor (PP) or based on a difference between the second pressure sensor (P1) and the third pressure sensor (PP), and wherein said controller is configured to detect a second pressure drop over said second valve, based on a difference between the second pressure sensor (P1) and the fourth pressure sensor (PT) or based on a difference between the first pressure sensor (P2) and the fourth pressure sensor (PT).

10. The control arrangement according to claim 9, wherein said first valve and/or said second valve are spool valves.

11. The control arrangement according to claim 4, wherein said first valve and said second valve each comprise means for indicating an opening degree, said means being connected to said controller.

12. The control arrangement according to claim 11, wherein said first valve and/or said second valve are spool valves.

13. The control arrangement according to claim 4, wherein said first valve and/or said second valve are spool valves.

14. The control arrangement according to claim 4, wherein, in case of a positive load, the first valve determines the velocity of the actuator connected to said working port arrangement and a back pressure is automatically adjusted to its minimum level.

15. The control arrangement according to claim 4, wherein, in case of a negative load, the second valve determines the velocity of the actuator connected to said working port arrangement and the first valve determines an anti-cavitation pressure.

* * * * *